US008863753B2

(12) United States Patent
Li et al.

(10) Patent No.: US 8,863,753 B2
(45) Date of Patent: Oct. 21, 2014

(54) POWER SUPPLY DEVICE FOR ELECTRONIC CIGARETTE

(76) Inventors: Yonghai Li, Guangdong (CN); Zhongli Xu, Guangdong (CN)

( * ) Notice: Subject to any disclaimer, the term of this patent is extended or adjusted under 35 U.S.C. 154(b) by 1029 days.

(21) Appl. No.: 12/914,891

(22) Filed: Oct. 28, 2010

(65) Prior Publication Data

US 2011/0304282 A1 Dec. 15, 2011

(30) Foreign Application Priority Data

Jun. 9, 2010 (CN) ..... 2010 2 0220247 U

(51) Int. Cl.
*A24F 13/00* (2006.01)
*A24F 47/00* (2006.01)

(52) U.S. Cl.
CPC ..... *A24F 47/008* (2013.01)
USPC ..... 131/329; 131/270; 315/362

(58) Field of Classification Search
USPC ..... 131/329, 194, 270, 273; 128/202.21; 318/362
See application file for complete search history.

(56) References Cited

U.S. PATENT DOCUMENTS

| | | | | |
|---|---|---|---|---|
| 5,269,327 | A * | 12/1993 | Counts et al. | 131/194 |
| 2012/0090630 | A1* | 4/2012 | Hon | 131/273 |
| 2013/0125906 | A1* | 5/2013 | Hon | 131/329 |
| 2013/0220315 | A1* | 8/2013 | Conley et al. | 128/202.21 |

* cited by examiner

*Primary Examiner* — Richard Crispino
*Assistant Examiner* — Dionne Walls Mayes
(74) *Attorney, Agent, or Firm* — Cheng-Ju Chiang

(57) ABSTRACT

A power supply device of an electronic cigarette is disclosed, the device comprising a battery and a control board installed inside a battery sleeve; the power supply device further comprises electrode connectors provided at one end of the battery for connecting an atomizer as a load into the circuit loop of the electronic cigarette, wherein the electrode connectors comprises a negative pole connector coupled to one end of the battery sleeve; a positive pole connector sit inside the negative pole connector; an insulation ring being provided between the negative pole connector and the positive pole connector to achieve electric isolation; the controlling board being provided at the other end of the battery inside the battery sleeve; the controlling board is integrated thereon a controller, a LED light and an airflow switch; the controller connecting the load connected between the positive pole connector and the negative pole connector into the power supply loop of the battery and controlling on/off of the LED light.

8 Claims, 3 Drawing Sheets

POWER SUPPLY DEVICE FOR ELECTRONIC CIGARETTE

CROSS REFERENCE TO RELATED PATENT APPLICATION

The present application claims the priority of the Chinese patent application No. 201020220247.1 filed on Jun. 9, 2010, which application is incorporated herein by reference.

FIELD OF THE INVENTION

The utility model relates to electronic cigarettes, particularly to a power supply device for supplying power to atomizing device of electronic cigarettes and simulating cigarette burning phenomenon.

BACKGROUND OF THE INVENTION

As hobby goods, cigarettes are widely favored by people, especially by men. However, tar contained in cigarettes is harmful to human health which includes dozens of carcinogenic ingredients, and secondary smoking is also very harmful to non-smokers, and smoking is prohibited in most public places. But it is very difficult for a smoker to quit smoke. Thus, a lot of cigarette substitutes are put onto the market within which the most common one is a product called non-flammable electronic atomizing cigarette containing no hazardous tar.

The present electronic cigarette on the market is mostly provided with an integrated structure, of which the front end is mainly a power supply device and the rear end is an atomizing device. When the atomizing device is supplied by the power supply device, a LED light of the power supply device will be illumined to simulate the scene of cigarette combustion.

Generally, the existing power supply device comprises a LED light and a circuit controlling board. Chinese patent (publication No.: CN101228969A, filed on Jul. 30, 2008) discloses an electronic cigarette, within which a power supply device comprises a power supply unit, a circuit controlling board and a LED board, wherein the LED board is installed on the front of the electronic cigarette, and the circuit controlling board is installed between the power supply unit and a fluid blocker of an atomizing device, so that the circuit controlling board supplies power to a heater of the atomizing device. Thus, the integrated structure of the electronic cigarette determines that the LED board of the power supply device can not be integrated with the circuit controlling board which will not only increase the complexity of the circuit structure but also reduce the reliability of the power supply device.

SUMMARY OF THE INVENTION

The purpose of the present utility model is to solve the problem existing in the prior art by providing a power supply device for supplying power to an atomizing device of electronic cigarette which has a simple structure.

The technical solution of the present utility model is that a power supply device of an electronic cigarette comprising a battery and a control board installed inside a battery sleeve; the power supply device further comprises electrode connectors provided at one end of the battery for connecting an atomizer as a load into the circuit loop of the electronic cigarette, wherein the electrode connectors comprises a negative pole connector coupled to one end of the battery sleeve; a positive pole connector sit inside the negative pole connector; an insulation ring being provided between the negative pole connector and the positive pole connector to achieve electric isolation; the controlling board being provided at the other end of the battery inside the battery sleeve; the controlling board is integrated thereon a controller, a LED light and an airflow switch; the controller connecting the load connected between the positive pole connector and the negative pole connector into the power supply loop of the battery and controlling on/off of the LED light.

Preferably, the other end of the battery sleeve is coupled with a lamp glass; the LED light is facing toward the lampshade.

Preferably, the negative pole connector is a screw thread bushing with an internal screw thread or an external screw thread, and the positive pole connector is an electrode collar.

Preferably, a switching component is integrated on the controlling board, a positive pole of the battery is connected to the positive port of the controlling board by means of the switching component which is controlled by the controller, the positive pole connector is electrically connected with the positive port, and the negative pole connector is electrically connected with a negative pole of the battery.

Preferably, a silica gel sleeve is provided between the controlling board and the internal wall of the battery sleeve. The utility model is advantageous in that the power supply device is electrically connected with the atomizing device through the electrode connectors, so that the wire for connecting the power supply device to the atomizing device is no longer necessary;, the power supply device can also be achieved the circuit connection through a simple arrangement of wires. Even if the LED light and the airflow switch are all integrated on the controlling board Thus, the utility model has advantages of a simple and compact structure, a stable quality of products and low cost. Otherwise, the power supply device of the utility model improves the sensitivity of the airflow switch due to the sealing effect of the silica gel sleeve, so that the user can truly appreciate the feeling of smoking.

DETAILED DESCRIPTION OF THE INVENTION

Hereinafter, the present utility model will be further illustrated with reference to the accompanied drawings.

Figure 1:
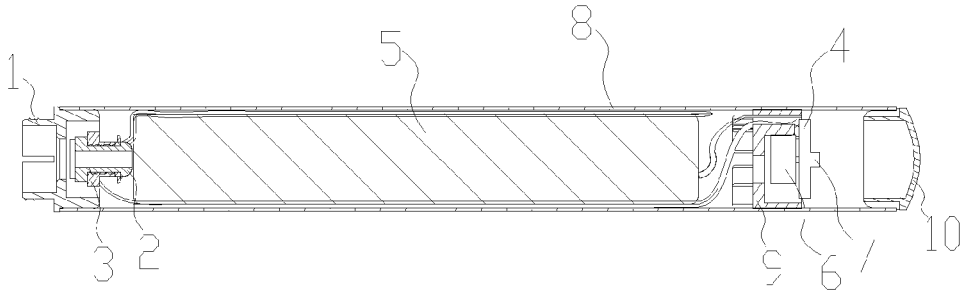
FIG. 1 is a schematic view of the power supply device according to one embodiment of the present utility model.
Figure 2:
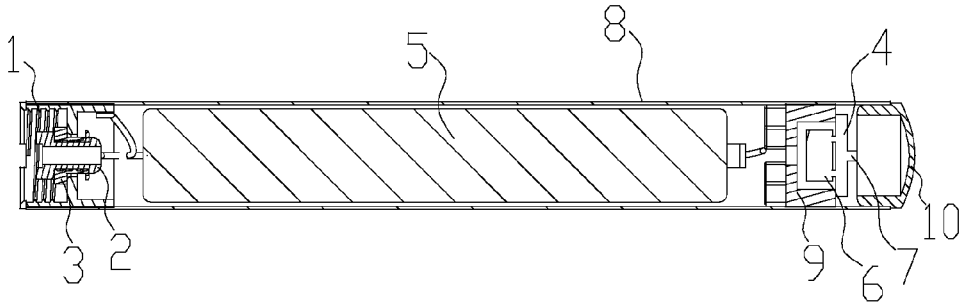
FIG. 2 is a schematic view of the power supply device according to another embodiment of the present utility model.
Figure 3:
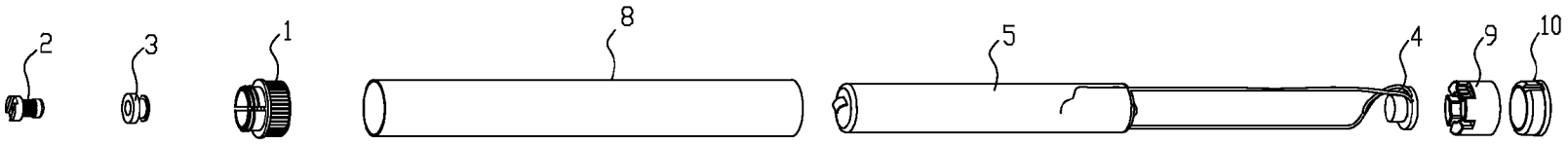
FIG. 3 is an exploded view of the power supply device in FIG. 1.
Figure 4:
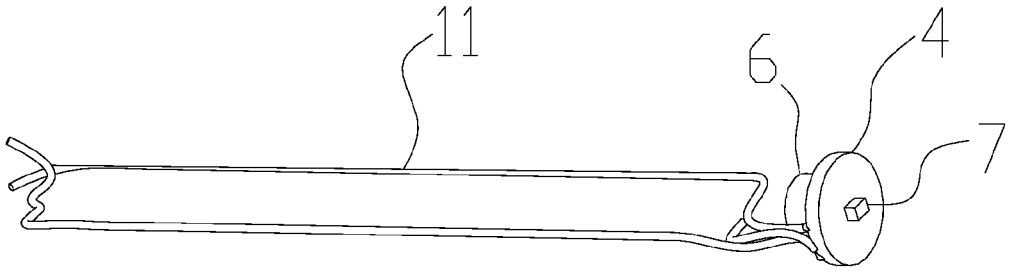
FIG. 4 is a schematic view of the PCB board in FIG. 3.

Referring to FIGS. 1, 2 and 3, a power supply device comprises: a battery 5, electrode connectors and a controlling board, wherein the battery 5 is installed inside a battery sleeve 8. The electrode connectors comprises a negative pole connector and a positive pole connector which are in the form of a screw thread bushing 1 and an electrode ring 2 respectively according to this embodiment, the screw thread bushing 1 is installed on one end of the battery sleeve 8 in order to match with the battery sleeve 8, the electrode ring 2 is installed inside the screw thread bushing 1, and the screw thread bushing 1 is separated from the electrode ring 2 by a insulation ring 3 to achieve the isolation between the positive electrode and the negative electrode. Power supply to an electric heating coil of the atomizing device for the electronic cigarette is achieved through the electrode connectors in this power supply device. The screw thread bushing 1 may adopt an external screw thread bushing shown as FIG. 1 or an internal screw thread bushing shown as FIG. 2. The screw thread bushing 1 of the power supply device should be in threaded connection with a screw thread bushing of the atomizing device of the electronic cigarette.

Referring to FIGS. 1 to 4, the controlling board is also installed inside the battery sleeve 8 and is disposed on one end of the battery 5 which is opposite to the end where the two electrode connectors are disposed; A controller, a LED light 7 and an airflow switch 6 are integrated on the controlling board 4. The battery 5 supplies power to the controlling board 4; the airflow switch 6 provides a switching signal for connecting a load (i.e. the atomizing device for the electronic cigarette) between the screw thread bushing 1 and the electrode ring 2 into a power supply loop. The airflow switch is normally a capacitive electronic switch which is equivalent to a variable capacitor. During smoking, the generated airflow can move a thin metal plate in the airflow switch which will then result in capacitance value change of the airflow switch, that is, the switching signal is generated.

In this embodiment, a switching component can also be integrated on the controlling board 4, whether the switching component is conducted is controlled by the controller, and whether the positive pole of the battery 5 is electrically connected to the electrode ring 2 is controlled by the conduct/block states of the switching component. For example, the switching component can be an NPN-type transistor, the positive pole of the battery 5 is electrically connected with a collector of the transistor, the electrode ring 2 is electrically connected with an emitter of the transistor, and the base of the transistor is controlled by the controller. Thus, when the controller outputs a high level to the base of the transistor, the transistor is in the saturation state and further connects the load to the power supply loop of the battery, that is, the controlling board 4 provides a positive port for the electrode ring 2. The screw thread bushing 1 is electrically connected to the negative pole of the battery 5 directly. When the electric cigarette senses inhale airflow, the airflow switch 6 acts and outputs a switching signal, consequently the controller activates the power supply loop between the power supply and the atomizing device. In order to simulate cigarette burning, the LED light 7 is glowed at the same time of generating smoke, the LED light 7 is controlled by the controller by: after the switching signal is received, the controller controls the lightening of the LED light 7 at the same time of activating the power supply loop. In this embodiment, the battery 5 can be a lithium battery cell, and all kinds of electric connections can be realized by wires 11.

Of course, controlling the load between the screw thread bushing 1 and the electrode ring 2 to the controlling circuit of the power supply loop of the battery is not limited to the above-mentioned way, that is, as long as the applied controlling circuit achieves that the battery is controlled by the controller for supplying power to the atomizing device according to the switching signal.

Referring to FIGS. 1 and 2, a lamp glass 10 can be installed on the other end of the battery sleeve 8, the LED light 7 is sitting toward the lamp glass 10, and the airflow switch 6 is toward the battery 5. The lamp glass 10 can evenly disperse the lights emitted out by the LED light 7, and can prevent users of the cigarette from contacting the inner circuit of the power supply device so as to assure user's safety.

If a gap exists between the controlling board 4 and the internal wall of the battery sleeve 8, a portion of the airflow ingoing from a inhale nozzle of the atomizing device may overflow though the gap, which would result in degradation of sensitivity of the airflow switch 6. In order to seal the gap between the controlling board 4 and the internal wall of the battery sleeve 8, a silica gel sleeve 9 is covered on the exterior of the controlling board and tightly contacts with the internal wall of the battery sleeve 8, so that the sensitivity of the airflow switch 6 is effectively improved.

In order to achieve intelligent control, a power supply managing chip can be integrated on the controlling board 4. When a user smokes the electronic cigarette, if the power supply managing chip detects that the voltage of the lithium battery is under normal value (e.g. the voltage is lower than 3.3V), the controller controls the LED light to glitter (such as 10 times) to remind the user that the power supply should be charged; if the power supply is connected with a charger, the power supply managing chip of the controlling board 4 can compare the voltage of the lithium battery cell with a reference value: if the voltage of the lithium battery cell is more than 4.0V and less than 4.2V, although the controller controls the LED light not to glitter, the charger will still charge the voltage of the lithium battery cell to 4.2V; if the voltage of the lithium battery cell is less than 4.0V, the controller controls the LED light to glitter, and in the meantime the charger will charge the voltage of the lithium battery cell to 4.2V.

The above description is only the preferred embodiments according to the present utility model; it is not intent to limit the implementing scope. That is to say that such changes and modifications according to the content of the application scope of the utility model all fall in the technical scope of the utility model.

What is claimed is:

1. A power supply device of an electronic cigarette comprising:

a battery and a control board installed inside a battery sleeve;

electrode connectors provided at one end of the battery for connecting an atomizer as a load into a circuit loop of the electronic cigarette, including a negative pole connector coupled to said one end of the battery sleeve, and a positive pole connector sitting inside the negative pole connector; and an insulation ring provided between the negative pole connector and the positive pole connector to achieve electric isolation; wherein the control board is provided at an opposite end of the battery inside the battery sleeve; wherein the control board is integrated on a controller, a LED light and an airflow switch; and wherein the controller connects a load connected between the positive pole connector and the negative pole connector into the power supply loop of the battery and thereby controls the on/off function of the LED light.

2. The device according to claim 1 wherein the opposite end of the battery sleeve is coupled with a lamp glass, the LED light being faced facing toward the lampshade.

3. The device according to claim 2, wherein the negative pole connector is a screw thread bushing with an internal screw thread or an external screw thread, and the positive pole connector is an electrode collar.

4. The device according to claim 2, wherein a switching component is integrated on the control board, a positive pole of the battery is connected to a positive port of the control board by means of the switching component which is controlled by the controller, the positive pole connector being electrically connected with the positive port, and the negative pole connector being electrically connected with a negative pole of the battery.

5. The device according to claim 2, wherein a silica gel sleeve is provided between the control board and an internal wall of the battery sleeve.

6. The device according to claim 1, wherein the negative pole connector is a screw thread bushing with an internal screw thread or an external screw thread, and the positive pole connector is an electrode collar.

7. The device according to claim 1, wherein a switching component is integrated on the control board, a positive pole of the battery is connected to a positive port of the control board by means of the switching component which is controlled by the controller, the positive pole connector being electrically connected with the positive port, and the negative pole connector being electrically connected with a negative pole of the battery.

8. The device according to claim 1, wherein a silica gel sleeve is provided between the control board and an internal wall of the battery sleeve.

* * * * *